US005331913A

United States Patent [19]

Tanaka et al.

[11] Patent Number: 5,331,913

[45] Date of Patent: Jul. 26, 1994

[54] ENCLOSED SHELTER FOR STORING BOATS AND LIFE RAFTS IN MARINE STRUCTURES

[75] Inventors: Tokumi Tanaka; Takaya Hayata; Ilkka Penttinen; Jarmo Seppälä, all of Nagasaki, Japan

[73] Assignee: Mitsubishi Jukogyo Kabushiki Kaisha, Tokyo, Japan

[21] Appl. No.: 840,757

[22] Filed: Feb. 25, 1992

[30] Foreign Application Priority Data

Feb. 27, 1991 [JP] Japan ..... 3-055852

[51] Int. Cl.[5] ..... B03B 35/40

[52] U.S. Cl. ..... 114/259; 114/366

[58] Field of Search ..... 114/365, 366, 375, 258, 114/259

[56] References Cited

U.S. PATENT DOCUMENTS

| | | | |
|---|---|---|---|
| 1,087,352 | 2/1914 | Cox et al. | 114/365 |
| 1,133,700 | 3/1915 | Basile | 114/366 |
| 1,810,564 | 6/1931 | Kelemen | 114/365 |
| 2,541,893 | 2/1951 | Speer | 114/375 |
| 2,949,617 | 8/1960 | Taylor | 114/375 |

OTHER PUBLICATIONS

Japanese Utility Model Provisional Publication No. 28097/1988 (63-28097).

Japanese Patent Provisional Publication No. 26190/1987 (62-26190).

Japanese Utility Model Provisional Publication No. 22297/1988 (63-22297).

*Primary Examiner*—Michael S. Huppert

*Assistant Examiner*—Thomas J. Brahan

*Attorney, Agent, or Firm*—Jacobson, Price, Holman & Stern

[57] ABSTRACT

A storage structure for a craft is mounted in a recess 1 which is disposed inside the ship 10 and at a safe distance from the water line of the ship 10 so as to store a craft 20. A guide rail 6*a* of a launching device 6 is installed on a deck 3 which is the ceiling plate of the recess 1 in such a manner that the guide rail is inclined downward toward the port 1*a* of the recess 1. At the gate 1*a*, a lower gate 13 and an upper gate 12 are installed. A winch 15 for opening/closing the lower gate 13 is mounted on the deck 3. The upper gate 12 is automatically opened by the movement of the craft 20 by gravity caused by the removal of a stop 6*d.* A winch 11 is mounted for the launching of the craft. 20.

7 Claims, 8 Drawing Sheets

ENCLOSED SHELTER FOR STORING BOATS AND LIFE RAFTS IN MARINE STRUCTURES

BACKGROUND OF THE INVENTION

1. Field of the Invention

This invention relates to a storage structure for crafts, such as lifeboats, combined tender/life boats, rescue boats, work boats, life rafts, and pleasure boats, in marine structures, such as ships, barges, offshore platforms.

2. Description of the Related Art

On a passenger ship as shown in FIGS. 8 and 9, lifeboats 20 have so far been stored by being suspended with ropes or cables 8 outside and in front of the windows of cabins 23 or general purpose spaces (as shown at the right in FIG. 8) or suspended with ropes or cables 8 in exposed positions outside the uppermost superstructure 24 (as shown at the right in FIG. 9).

In FIGS. 8 and 9 the launching condition of a lifeboat 20 is shown on their left hand side, and reference numeral 25 denotes a launching device and 26 denotes a hanging arm.

Such a conventional storage apparatus for small boats such as lifeboats has the following problems:

(1) The boats and life rafts and the launching equipment are exposed to weather and external damages.

(2) The lifeboats obstruct an outside view from the cabins 23, leading to a decrease in the value of the cabins and, in turn, income from the cabins.

(3) When the lifeboats are stored at the uppermost level of the superstructure, the distance is large between the water surface 21 and the storage/boarding position, and the lifeboats can possibly be put in danger during launching because of movement of the ship and the crafts in rough weather.

SUMMARY OF THE INVENTION

Accordingly, it is an object of the present invention to provide a storage structure for crafts in a marine structure, in which a recess for storing the crafts including its launching device is disposed inside the ship at a safe distance from the water surface.

To attain the above object, the storage structure for a craft in a marine structure is characterized by a recess which is disposed inside the marine structure and at a safe distance to the waterline of the marine structure in such a manner that the crafts can be stored therein and can be launched through a gate on the side or on the floor of the recess, and a launching device for launching the craft stored in the recess.

This invention provides a storage structure for one or more crafts in a marine structure which is extending downwardly from the storage structure to a normal water line, the storage structure comprising a recess for containing the craft which recess is openable and closable above the water line by a single or multipartite gate, craft support means in said recess supporting the craft therefrom, mounting means in the recess for moving the craft support means together with said crafts from a storing position wholly within the recess or from an embarking position outwardly of the recess, the craft support means including means for lowering and hoisting the craft between the craft storing position and the water line.

The craft can be safely embarked and launched as compared with the conventional passenger ship because of the safe distance between the sheltered storage/boarding position and the water surface.

BRIEF DESCRIPTION OF THE DRAWINGS

FIG. 7 is a transverse vertical sectional view of another embodiment of passenger ship of FIG. 5, and FIGS. 8 and 9 are transverse vertical sectional views of passenger ships equipped with a conventional storage structure for a lifeboat or the like.

DETAILED DESCRIPTION OF THE PREFERRED EMBODIMENTS

Figure 1:
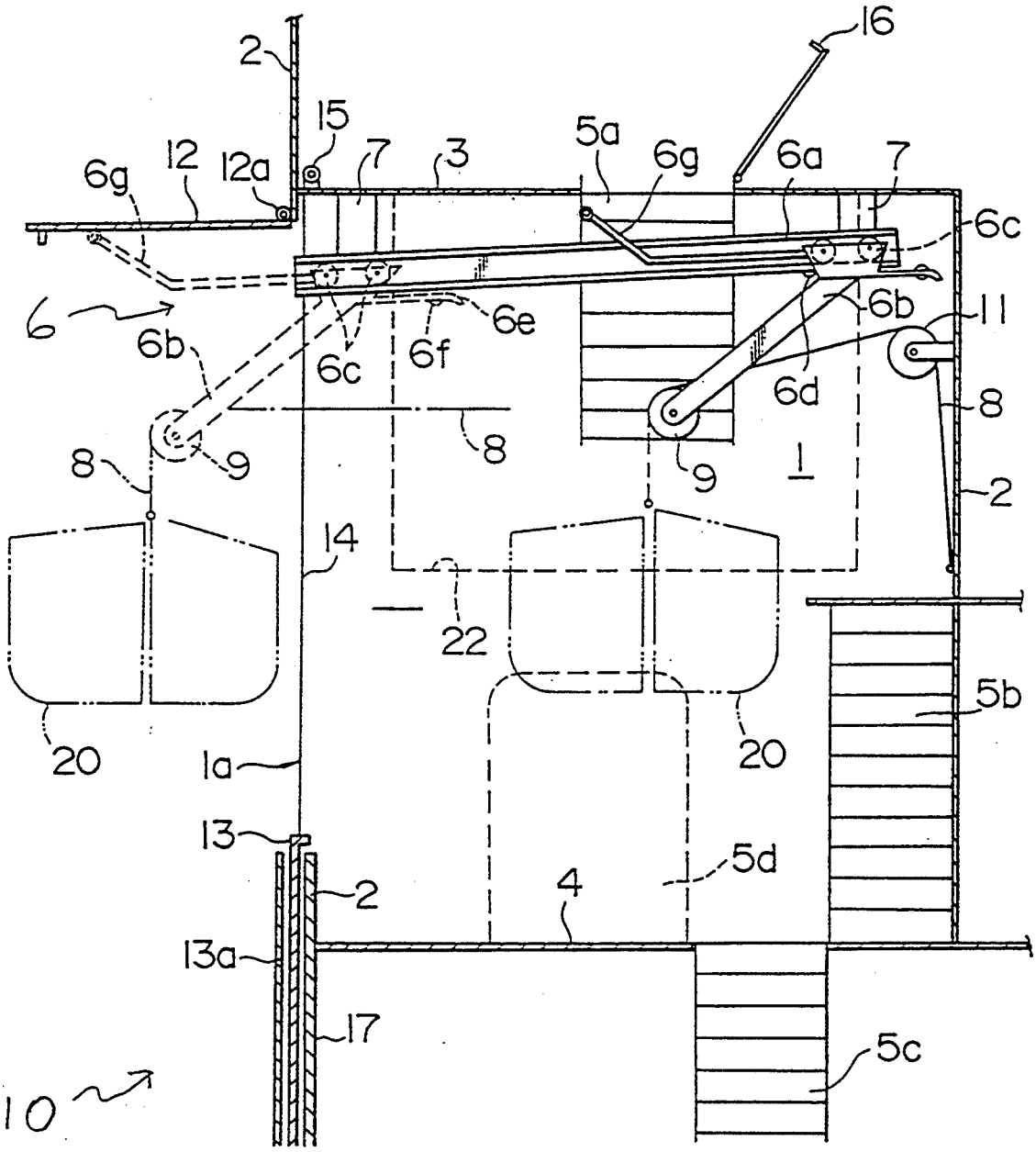
FIG. 1 is a fragmentary, transverse vertical sectional view of an embodiment of the storage structure for a lifeboat or the like on a marine structure according to this invention.
Figure 2:
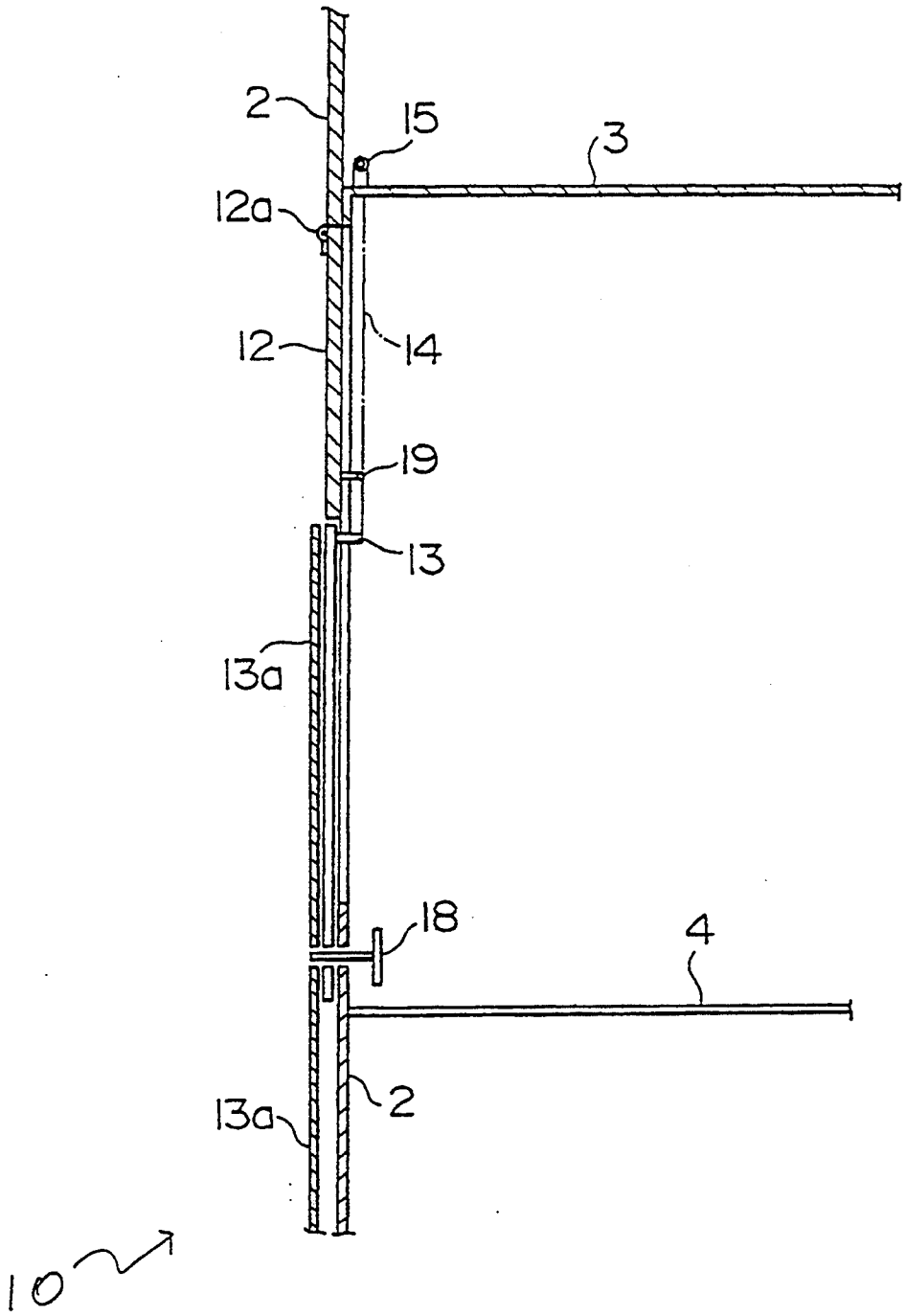
FIG. 2 is an enlarged transverse vertical sectional view similar to FIG. 1 with the gate being in the closed position.
Figure 3:
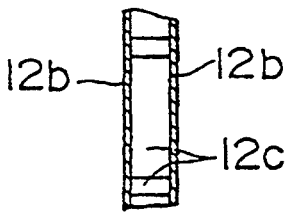
FIG. 3 is a fragmentary, horizontal sectional view of the gate of FIG. 1.
Figure 4:
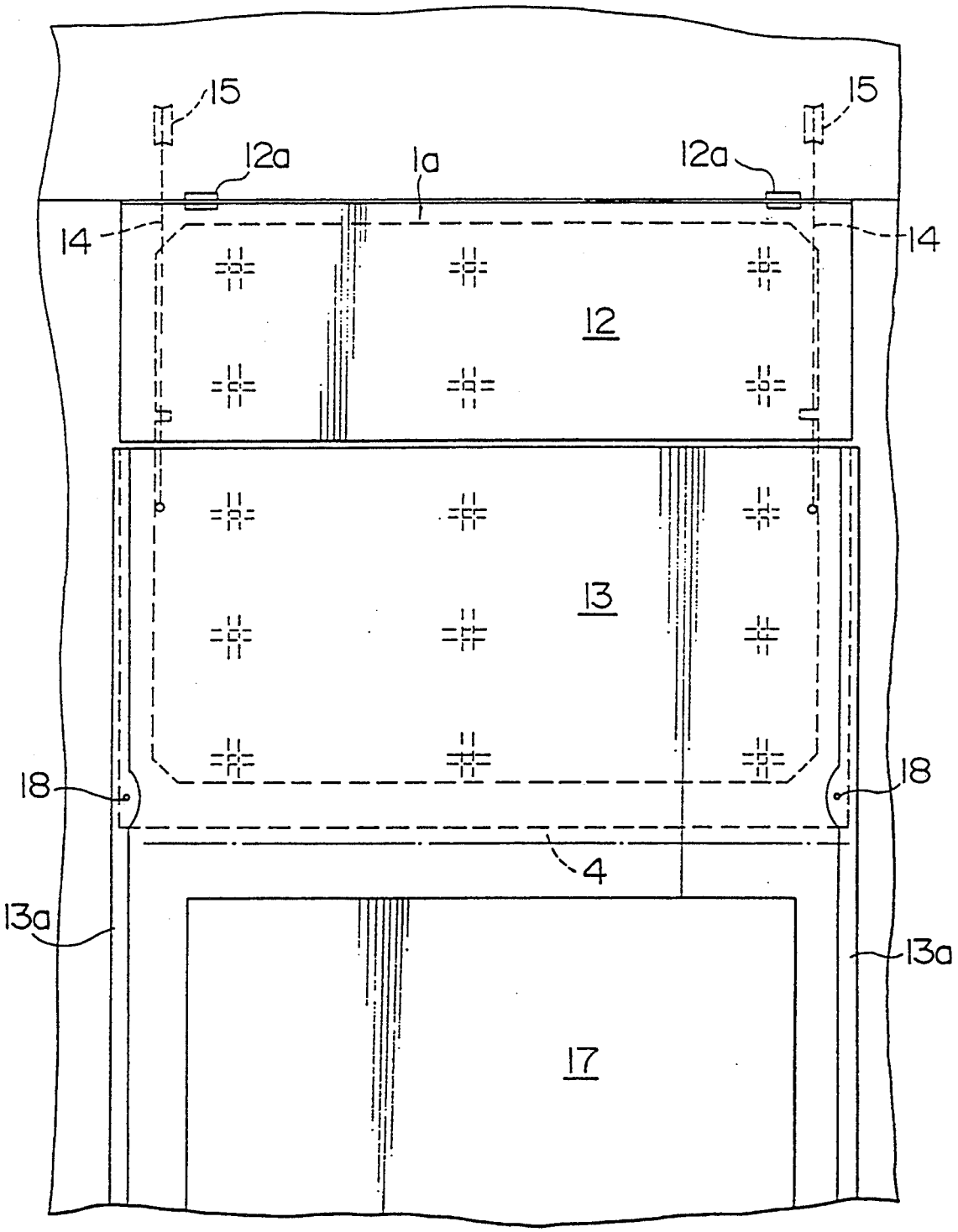
FIG. 4 is an elevational view of the gate of FIG. 1.
Figure 5:
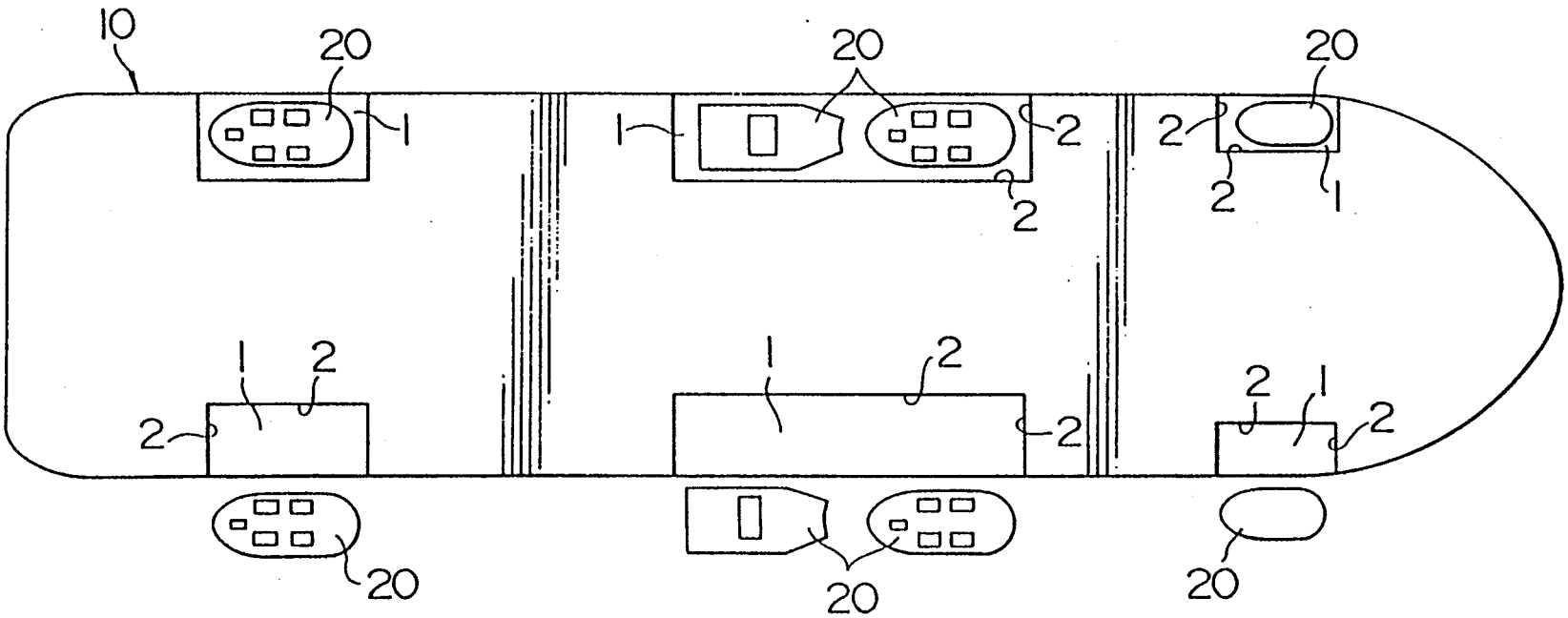
FIG. 5 is a plan view of a passenger ship which is an example of marine structure having a craft storage structure according to this invention.
Figure 6:
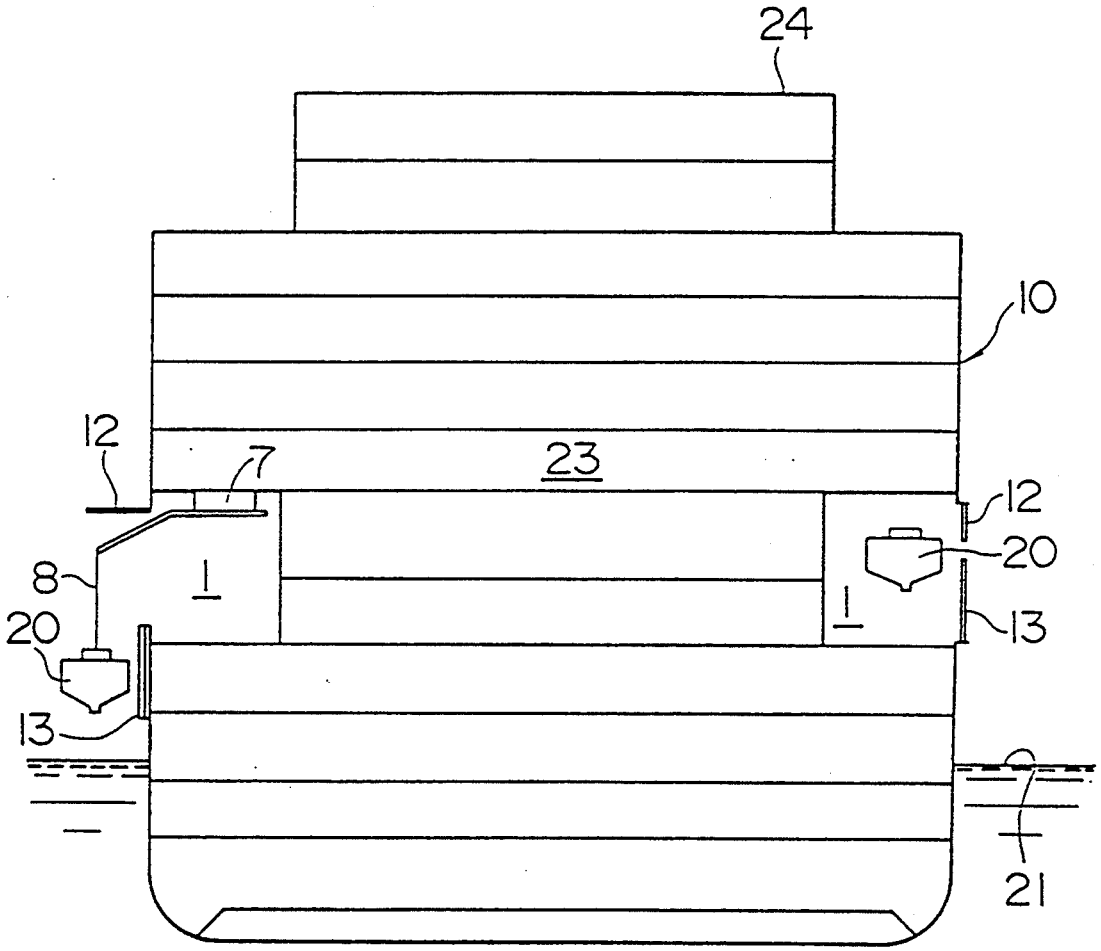
FIG. 6 is a transverse vertical sectional view of the passenger ship of FIG. 5.
Figure 7:
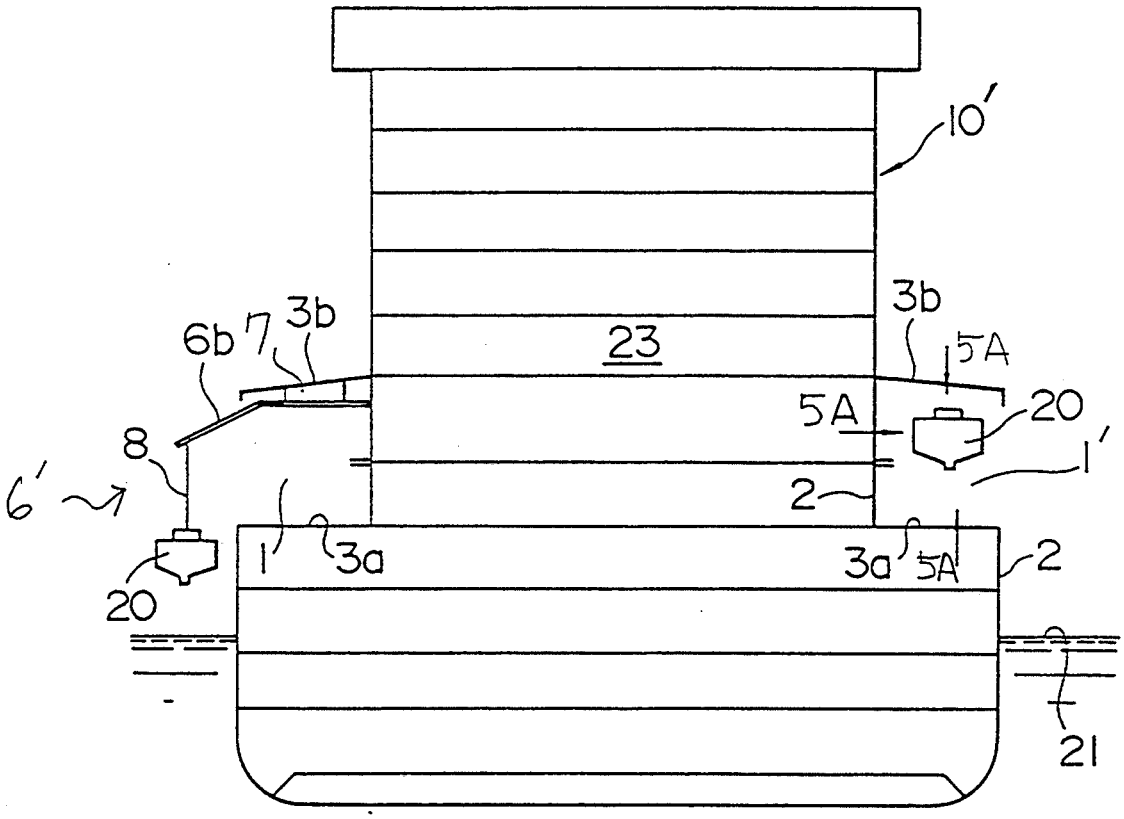
Figure 8:
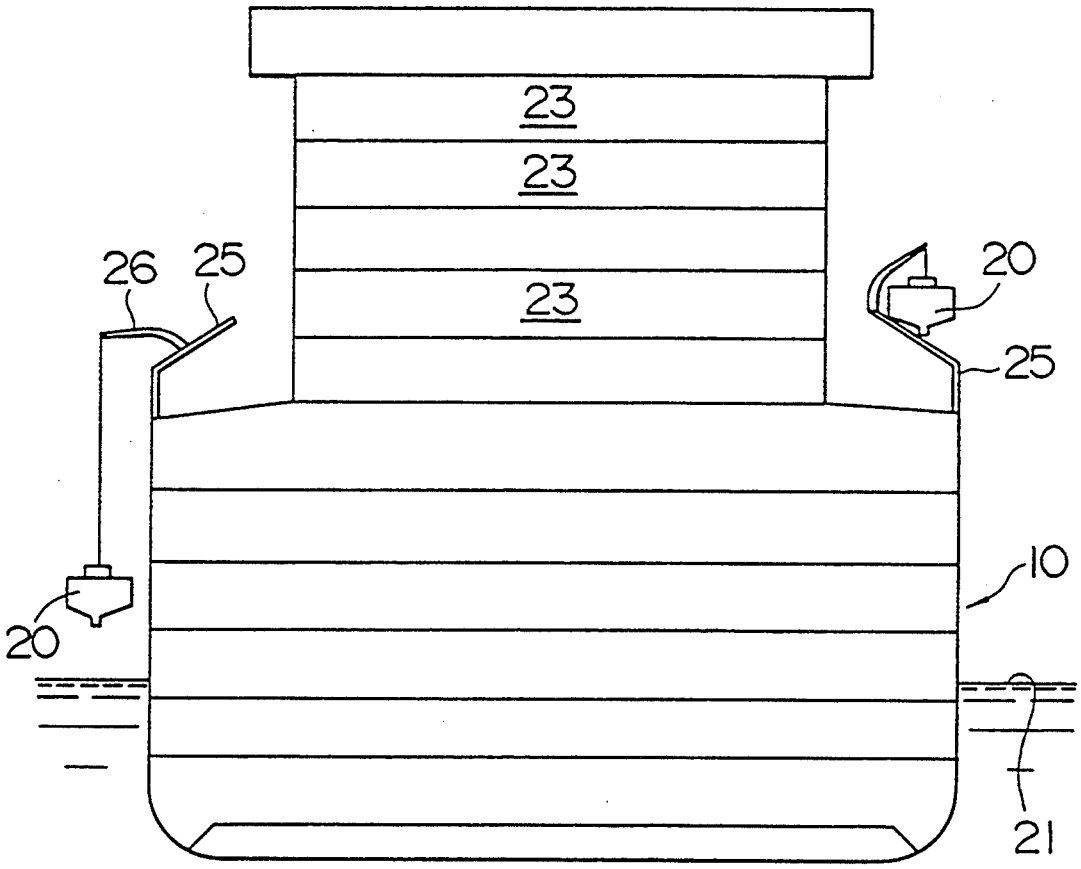
FIG. 8 PRIOR ART
Figure 9:
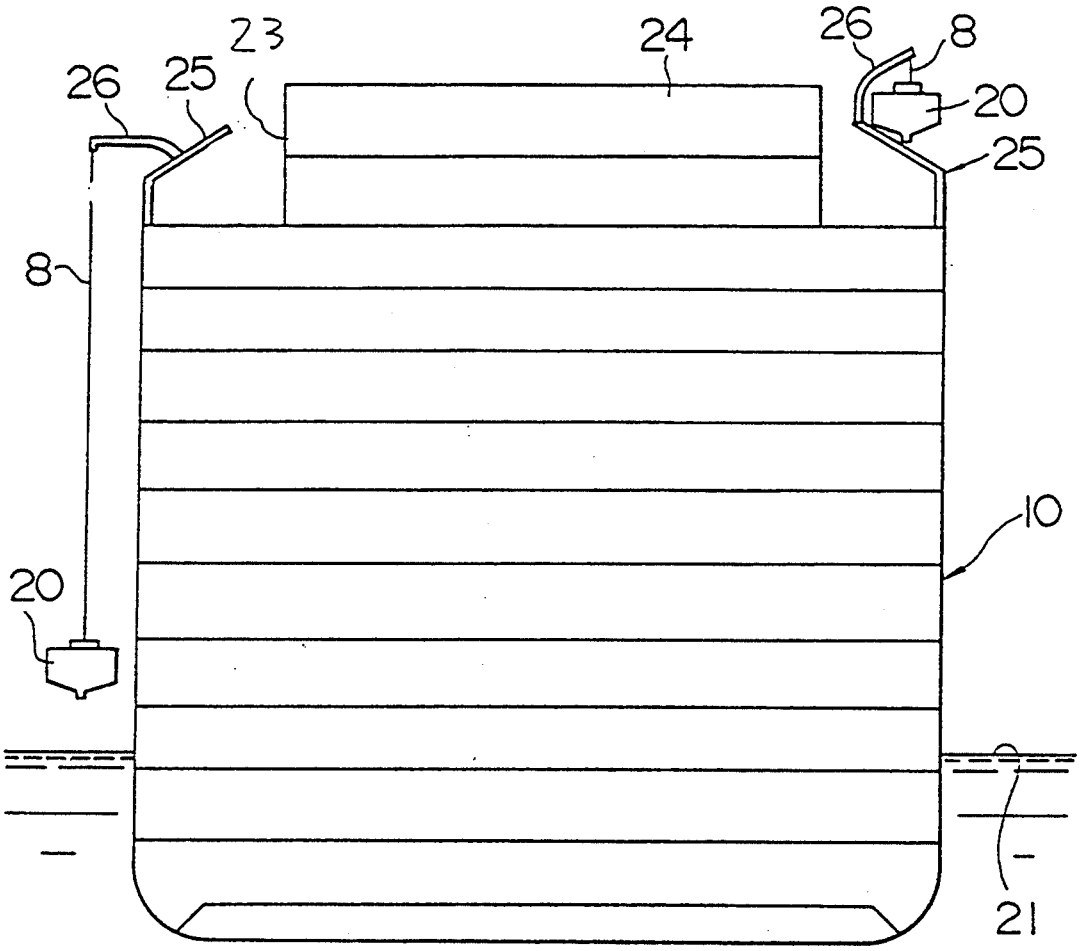
FIG. 9 PRIOR ART

An embodiment of a storage structure for a craft in a marine structure will be described with reference to the drawings. FIG. 1 is a transverse sectional view of a storage structure, FIG. 2 is a transverse sectional view similar to FIG. 1 illustrating the main portion of storage structure with the gate being in the closed position, FIG. 3 is a horizontal sectional view of the gate, FIG. 4 is an elevational view of the gate, FIG. 5 is a plan view of a passenger ship which is an example of marine structure having a storage structure according to this invention, FIG. 6 is a transverse, vertical sectional view of the passenger ship of FIG. 5, and FIG. 7 is a transverse, vertical sectional view of another embodiment of marine structure according to this invention.

In the embodiment shown in FIG. 1, a lifeboat 20 is stored on a ship 10. A recess 1 which can accommodate one or more crafts 20 is disposed at a safe distance from the waterline 21 (see FIG. 6) of the ship 10.

The recess 1 can be disposed at each side of the main hull of the passenger ship 10. The recess 1 is equipped with a gate opening or port **1*a* for launching the lifeboat 20 at one side, and surrounded by a ship shell plate 2, a deck ceiling plate 3 and a floor plate 4. The recess 1 includes ladders 5*a*, 5*b* and 5*c*. A passage having a door 5*d* may be connected to the recess 1. As shown by arrows 5A in FIG. 7, the recess 1** is so constructed as to be accessible from a plurality of directions.

A launching device 6 for the lifeboat 20 is mounted from the deck plate 3 of each recess. The launching device 6 comprises a guide rail **6*a* installed on the lower surface of ceiling plate 3 with support members 7 so that it is downwardly inclined toward the ship side, a boat hanging arm 6*b* extending in the launching direction, traveling rollers 6*c* for guiding the hanging arm 6*b* along the guide rail 6*a*, and a detachable stop 6*d*. The launching device 6 also has a reaction absorber 6*e*, an auxiliary roller 6*f*, and a push-up lever 6*g* installed in front of the guide rail 6*a*** in a horn-shaped fashion.

A roller 9 over which a wire 8 is passed is installed at the lower part of the hanging arm **6*b*, and the lifeboat 20 is hung at the lower end of the wire 8. The base end of the wire 8 is wound around a winch 11 mounted on the ship side shell plate 2 defining the side wall of the recess 1**.

The gate opening or port 1*a* is closed by an upper gate opening or port 12 and a lower gate 13. The base of the upper gate 12 is pivotally secured to the ship shell plate 2 by a pivot shaft 12*a* at the upper end of the gate opening 1*a*. The gate 13 can slide vertically along a guide plate 13*a* installed at the two vertical side margins of the gate 13. By winding a wire 14, whose lower end is connected to the upper end of the lower gate 13, upon a winch 15 on the deck plate 3, the lower part of the gate 1*a* may be closed.

In FIG. 1, reference numeral 16 denotes a ladder opening cover installed in such a manner that it can be freely opened and closed, and 17 denotes a window glass in the ship shell plate 2.

The lower gate 13, in its closed position, is pulled toward the hull side by the operation of locking bolts with handle 18, and is kept in a locked position (refer to FIG. 2). The upper gate 12, in its closed position, is kept in a locked position by a locking hardware 19 secured by the wire 14.

The upper gate 12 is constructed by connecting two steel sheets 12*b* with steel spacer members 12*c* therebetween. The lower gate 13 also has a similar construction. Therefore, both the upper and lower gates are light in weight and very stiff.

On the side of the recess 1, an air intake opening 22 for air conditioning (or an exhaust opening) is disposed at such a position where it does not obstruct the ladder 5*a*.

Reference numeral 21 in FIGS. 6 and 7 denote the water surface.

In another embodiment of the launching device is shown in FIG. 7 and designated by the numeral 6', an intermediate deck 3*a* of a passenger ship 10' is used as the storage structure. A ceiling 3*b* is installed over the intermediate deck 3*a* to form a recess 1' which can accommodate a craft 20. This recess 1' has the launching device 6' suspended from a support member 7' for the craft 20, ladders, and so on, similar to that shown in FIG. 1.

In the above-described construction, the gate 1*a* of the recess 1' is normally closed with an upper gate 12' and a lower gate 13' similar to that shown in FIG. 2. In these conditions the launching device 6' is in the boat storage position indicated by solid lines in FIG. 1.

The launching operation is performed by using the following procedure.

First, the lower gate 13 is lowered by the operation of the winch 15. Next, the stop 6*d* is removed, and the winch 11 is released. Thus, the craft 20 together with the boat hanging arm 6*b* moves along the guide rail 6*a* toward the opening or port 1*a* by gravitation. The lever 6*g* which is integral with the boat hanging arm 6*b* also moves toward the gate 1*a*. The end of the lever 6*g* pushes up the upper gate 12 toward the outside (as indicated by dotted lines in FIG. 1), so that the opening or port 1*a* is fully opened. Thus, the craft 20 is brought out through the opening or port 1*a*. Then, the craft 20 can be softly launched by slowly releasing the winch 11.

Needless to say, the storage operation of the craft 20 can be performed by reversing the above launching procedure.

The craft storage structure of this invention has the following benefits:

(a) The craft 20 can be stored at a position unrelated to cabins, so that the craft does not obstruct an outside view from the cabins.

(b) The craft 20 can be safely launched and embarked as compared with the conventional passenger ship because of a safe distance between the storage position and the water surface.

(c) The craft is protected from rain, wind, direct sunlight, snow, fire or damage because it is stored in a compartment enclosed by the ship shell plate, and gates 12 and 13 installed in such a manner that they can be opened and closed. Therefore, this storage structure is superior to the conventional storage structure in terms of the maintenance of crafts and launching devices and the safety of boarding or leaving the craft.

(d) The structure for installing the launching device is simple because the ceiling members of the storage recess is used for installing the launching device.

(e) Installation of air intake openings for air conditioning or exhaust openings in the storage recess reduces noise as compared with the case where the opening is installed elsewhere.

(f) When a fire occurs, survival crafts can be launched while being protected from the fire and heat emitted from the inside of the marine structure because the lower gate 13 in its open position acts as a fire-proofing member against the windows, window frames, and other ship structures located between the storage position and the water surface.

(g) The upper gate 12 in the open position acts as a protector against objects falling from above, which further ensures the safety of craft launching.

(h) The launching operation is simple because the upper gate 12 is automatically opened by the hanging ann.

What is claimed as new is as follows:

1. A storage structure for one or more crafts in a marine structure including an upstanding side which extends downwardly from the storage structure to a normal water line, said storage structure including a recess inwardly of said side for containing said craft, said recess being openable and closable relative to said side above said water line by shiftable gate means, craft support means in said recess supporting said craft therefrom, mounting means in said recess for moving said craft therefrom, mounting means in said recess for moving said craft support means together with said crafts from a storing position wholly within said recess to a launching position outwardly of said recess and side, said craft support means including means for lowering and hoisting said craft between said launching position and said water line, said recess opening outwardly of said side through a port formed therein including upper, lower and opposite side margins, said gate means including upper and lower gates operatively associated with said port and movably supported from said side for movement between open and closed positions opening and closing, respectively, the upper and lower portions of said port, said upper gate being pivotally supported along an upper margin thereof from the upper margin of said port for swinging in a generally vertical plane for movement between the open and closed positions thereof with said upper gate being generally coextensive with said lower gate when both of said gates are in the closed positions thereof and said upper gate projecting generally horizontally outwardly of the upper marginal portion of said port when said upper gate is in the open position thereof with said craft support means maintaining said upper gate propped in the open position thereof when said craft support means is in said craft launching position, said lower gate being supported from said side for generally vertical guided movement between a lowered open position and a raised closed position.

2. The storage structure of claim 1 wherein said mounting means includes elongated guide means mounted in said recess from which said craft support means is mounted for guided movement therealong, said guide means extending toward and away from said side.

3. The storage structure of claim 2 wherein said elongated guide means is downwardly inclined toward said side for gravity movement of said boat support means therealong toward said side.

4. The storage structure of claim 1 including means independent of said craft support means operative to open and close said lower gate.

5. The support structure of claim 4 wherein said craft support means open and upper gate include coacting structure operative to automatically and close said upper gate responsive to movement of said craft support means toward and away from said launching position.

6. The storage structure of claim 1 wherein said recess is disposed closely above said normal water line.

7. The storage structure of claim 1 wherein said side includes a window therein beneath said port and downwardly over which said lower gate is moved when lowered from its closed position to its open position.

* * * * *